United States Patent [19]

Simpson

[11] 4,353,425

[45] Oct. 12, 1982

[54] GUIDE TUBE SUPPORT FOR ROTARY IMPACT HAMMER

[75] Inventor: Frank F. Simpson, Staines, England

[73] Assignee: Black & Decker Inc., Newark, Del.

[21] Appl. No.: 181,819

[22] Filed: Aug. 27, 1980

[30] Foreign Application Priority Data

Aug. 31, 1979 [GB] United Kingdom ..... 7930272

[51] Int. Cl.[3] ..... B25D 11/06; B25D 17/24

[52] U.S. Cl. ..... 173/109; 173/139

[58] Field of Search ..... 173/109, 122, 118, 139; 81/463, 464

[56] References Cited

U.S. PATENT DOCUMENTS

| | | | |
|---|---|---|---|
| 2,559,478 | 7/1951 | Stone | 173/139 X |
| 3,023,413 | 3/1962 | Fischer et al. | 173/139 X |
| 3,055,344 | 9/1962 | Fisher | 173/139 X |
| 3,881,554 | 5/1975 | Cooley et al. | 173/139 |
| 4,203,446 | 5/1980 | Hufert et al. | 173/139 X |

FOREIGN PATENT DOCUMENTS

| | | | |
|---|---|---|---|
| 25153 | 3/1981 | European Pat. Off. | 173/109 |
| 2511041 | 9/1976 | Fed. Rep. of Germany . | |
| 2611678 | 9/1977 | Fed. Rep. of Germany | 173/139 |

*Primary Examiner*—Werner H. Schroeder
*Assistant Examiner*—Andrew M. Falik
*Attorney, Agent, or Firm*—Walter Ottesen; Edward D. Murphy; Harold Weinstein

[57] ABSTRACT

There is disclosed a combination rotary and percussive portable tool driven by an electric motor. The percussive tool includes a reciprocating cylinder having embodied therein a reciprocatable piston striker. The cylinder is mounted in a guide tube which is spring loaded by a spring positioned between an internal wall in the housing and a cap removably mounted over an opening of the housing. The opening provides access to the housing in order to remove the guide tube and spring. With the guide tube resiliently mounted in the housing, the guide tube and its interface with the housing is much less affected by the vibration and thermal conditions developed during operation of the tool. In addition, the tolerances required to mount the guide tube in the housing do not have to be kept as tight as they would have to be if a conventional mounting arrangement using welds or other rigid fastening devices were used.

14 Claims, 8 Drawing Figures

GUIDE TUBE SUPPORT FOR ROTARY IMPACT HAMMER

BACKGROUND OF THE INVENTION

The general area to which the present matter applies is to power tools which incorporate reciprocatory motion. Examples of such tools are impact wrenches, hedge trimmers and rotary percussive drills.

In rotary percussive drills, it is known to impart percussive movement to the bit holder by means of a piston movable in a cylinder to which movement along the axis of the cylinder is imparted by suitable drive means coupled to the electric motor. The cylinder is mounted within a guide tube secured in the drill housing. However, it is found that the guide tube is subjected, during use, to a degree of vibration and differential thermal expansion and this reacts on the securing means to loosen such means when they are screws or to stress them unduly when other forms of securing means are employed.

BRIEF SUMMARY OF THE INVENTION

The present invention relates to a rotary hammer tool or the like wherein there is provided an improved means of supporting the guide tube in the housing whereby the guide tube is somewhat isolated from vibrational and thermal influences. At the same time the improved structure may be favorably fabricated with a lower standard of tolerances. The guide tube is resiliently urged against a supporting surface.

The guide tube is mounted in a housing and, more particularly in an annular support space located between the ends of the guide tube. One end of the guide tube is positioned in a socket formed in a removable cap component and spring means of unusual configuration is provided and the guide tube is thereby resiliently urged against the cap and into the socket. The spring partially encircles the guide tube and has an end that reacts against a support plate. The support plate itself may be a separate component which may be carried by parts of the tool.

BRIEF DESCRIPTION OF THE DRAWINGS

The invention will now be described with reference to the drawings wherein.

DESCRIPTION OF THE PREFERRED EMBODIMENT OF THE INVENTION

Now, turning to the drawings, attention is first directed to FIG. 1 for a consideration of the rotary hammer tool per se in order to demonstrate the utilization of the improvement hereinafter disclosed with specificity.

As was stated, the device is a rotary hammer 11 driven by an electric motor 12. The desire is to drive a rotating drill bit and to impart to the drill bit percussive shocks in order to assist in the boring of hard materials such as concrete, bricks and/or rock.

Figure 1:
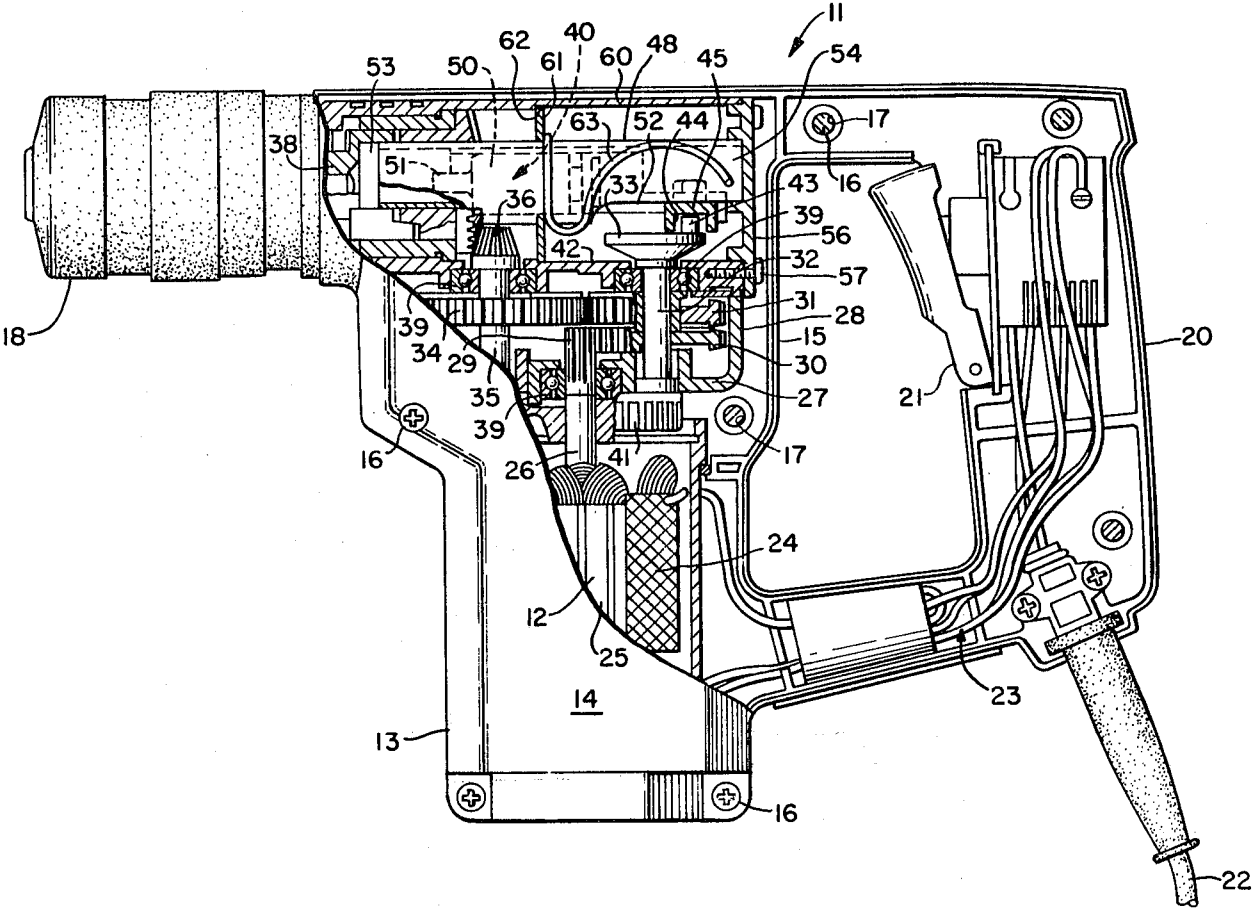
FIG. 1 is a side elevation of a portable tool equipped with the improved guide tube supporting arrangement according to the invention with the area of interest broken away.

The rotary hammer shown in FIG. 1 includes a housing 13 constructed of two clam shell mating parts 14, 15 which are secured together by machine screws 16 in one clam shell part 14, which screw into female threaded bores 17 located in the other clam shell molding 15. A drill bit tool holder 18 is located to the left of FIG. 1 while a pistol grip handle 20 is positioned to the right thereof. The handle 20 is supplied with an electric trigger switch 21 for controlling the electricity from an electric conduit 22 depending from the handle. The wires 23 seen in the handle 20 then carry the electrical energy to the stator 24 and armature 25 of the electric motor 12 as seen in the body of the housing 11. A drive shaft 26 integrally projects from the electric motor 12 and is rotatably supported in and extends through the lower face 27 of a transmission gear box 28 containing gears for transmitting rotation from the drive shaft 26 which terminates in a pinion 29. The pinion is in operative relationship to drive an input gear 30 which is suitable friction clutched to an output gear 31 by conventional friction plate means whereby the electric motor 12 rotatingly operates even though the drill bit may become hung up for some reason or other. The output gear 31 is splined or the like to a secondary drive shaft 32 which terminates in a crank 33. The output gear 31 also drives another driven gear 34 which is splined or the like to an output spindle drive shaft 33. The spindle terminates in a bevel gear 36 which is in operative cooperation with annular bevel gear 37 located at one end of an elongated tubular output spindle 38 which is adapted and constructed to rotate the drill bit (not shown). The annular output spindle 38 surrounds a portion of the aforementioned percussive mechanism, shown generally at 40, and is concentric therewith. It can be seen from the drawing of FIG. 1 that suitable journaling and bearing means 39 are provided, which bearings are deemed to be conventional and suitable for the tasks to be performed. The electric motor 12 is also supplied with cooling airflow through a fan 41 which is keyed to the first drive shaft of the electric motor.

Of interest also to the instant matter is the fact tht the gear box 28 has an upper wall 42 through which the secondary drive shaft 32 and the output spindle shaft 35 project.

The eccentrically located pin 43 making up part of the crank 33 rides in the channel 44 of a U-shaped bracket 45. The bracket 45 is secured to an axial projection 46 of a cylinder 47 slidably mounted for axial movement in a guide tube 48. The cylinder 47 is reciprocated in tube 48 by the crank and is supplied with a freely movable piston 50 formed with a striker 51 at its forward end. The striker 51 is adapted and constructed to impart percussive action to a beat piece 59 which, in turn, transmits the axial blows to a drill bit (not shown) held in the tool holder 18.

As was stated, the cylinder 47 is mounted for axial movement in the guide tube 48. The guide tube 48 consists of a hollow open ended tube having a considerable cutaway portion 52 to accommodate the crank 33, the pin 43 thereof and the U-shaped bracket 45 aforementioned; which, as was stated imparts reciprocating motion to the cylinder 47. The guide tube 48 terminates at one end 53, adjacent and internal of the annular rotary output spindle 38 for rotating the tool holder. The other end 54 of the tube 48 is supported in a socket arrangement 55 formed internally on a cap 56. The cap 56 is retained in position by machine screws 57 threaded into suitably positioned female threaded bores 58 in the housing for the percussive mechanism 40.

Approximately midway of the two ends of the guide tube 48, it is surrounded by first mounting means in the form of an annular support wall 61 which is butted against upper and lower shoulders 62 formed on the inner wall of the housing 60.

The end of the guide tube 48 is held in the socket arrangement 55 by resilient means in the form of a spring 63 having an unusual configuration positioned at the right-hand end of the guide tube, that is, between the cap 56 and the annular support wall 61. The cap 56 can be viewed as being a second mounting means arranged with respect to the housing 13. The spring 63 is in abutment with the annular support wall 61 at one end and is suitably affixed near the end 54 of the guide tube proximate the cap 56.

Figure 2:
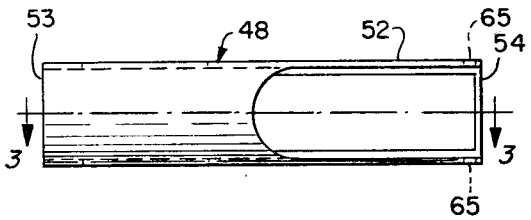
FIG. 2 is a bottom view of the guide tube.
Figure 3:
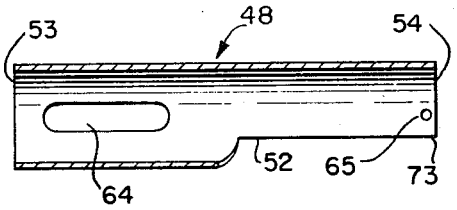
FIG. 3 is a cross-sectional view taken along line 3—3 of FIG. 2.

To obtain a better understanding of the guide tube 48 attention is now directed to FIGS. 2 and 3. FIG. 2 shows the cutaway portion 52 of the guide tube 48 to provide space for accommodating the crank 33, pin 43 and bracket 45 as well as the reciprocatory movement of the bracket when the cylinder 47 is reciprocated. FIG. 3 displays the guide tube 48 in axial cross-section showing one of the elongated axial slots 64, there being two of such slots 180° apart. Additionally, near one end of the guide tube are two radial holes 65, 180° apart adapted and constructed to accept right angle bent portions 66 of the spring 63, as seen from FIG. 8.

Figure 4:
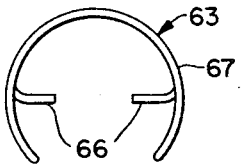
FIG. 4 is an end view of the spring which surrounds the guide tube.
Figure 5:
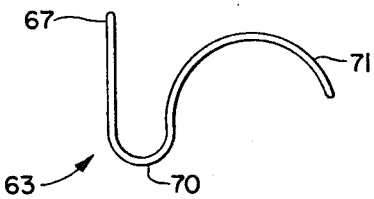
FIG. 5 is a side view of the same spring.
Figure 6:
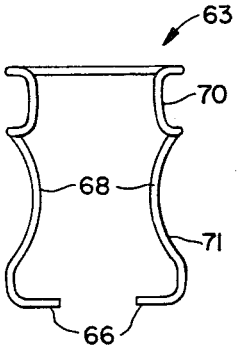
FIG. 6 is a bottom view of the same spring.

For a further review of the spring, note FIGS. 4, 5 and 6. The spring 63 has a looped end 67 which abuts the annular support wall 61. The spring from the looped end thereof has two limbs 68 extending therefrom. The limbs 68 are of similar configuration each having a first downwardly extending curved portion 70 in the direction from the loop which then turn into second upwardly extending curved portions 71 describing thereby as seen from FIG. 5 assymmetric sinusoidal curves terminating in the right angle bent portions 66 as can be readily seen from FIGS. 4 and 6. It is pointed out that the extremities subtend an angle of about 270° from the looped end 67.

It should be pointed out that the configuration of the spring is such that there is no overlap into the cutaway 52 of the guide tube 48. If a helical spring were employed, parts thereof would obstruct the movement of the cylinder as the driving mechanism therefor could not operate. Additionally, the spring employed imparts more uniform pressure against its abutments than would be possible if a helical spring was employed.

Figure 7:
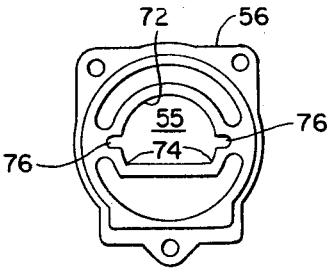
FIG. 7 is a view of the end cap of the housing showing the internal structure thereof.
Figure 8:
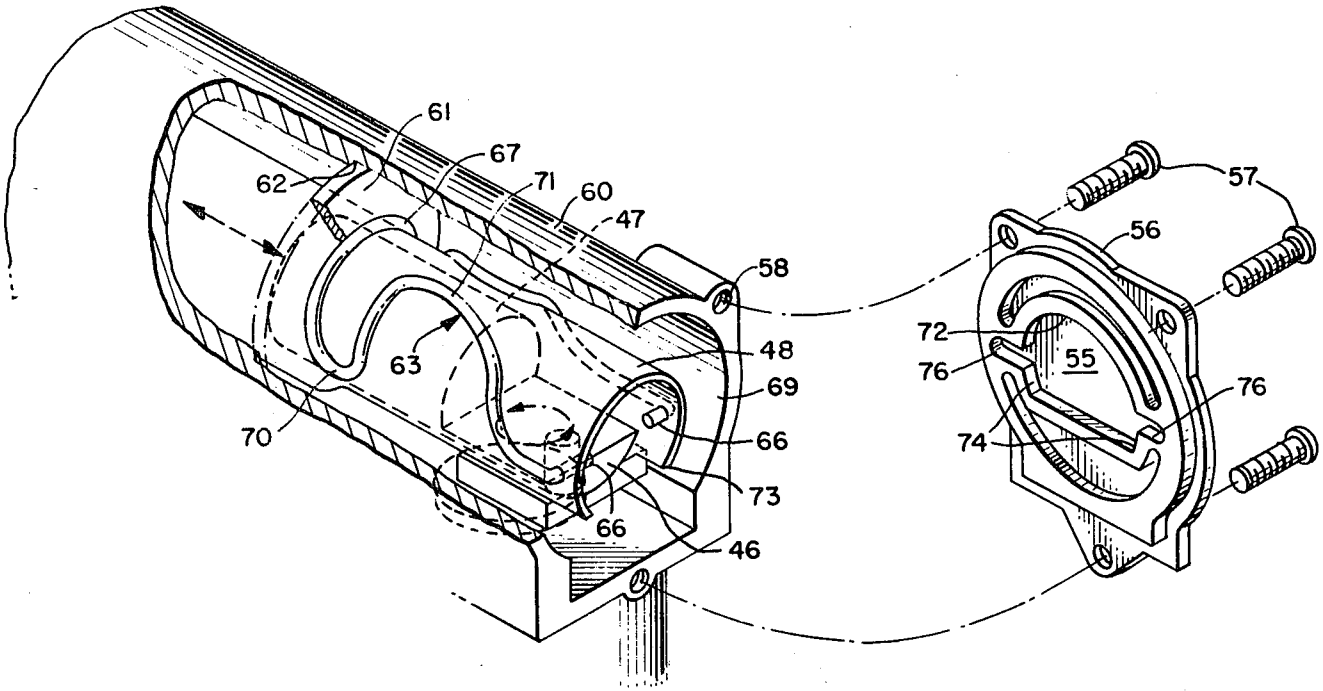
FIG. 8 is a view in perspective of the guide tube and spring in position with the end cap exploded therefrom.

The end cap 56 as aptly seen from FIGS. 7 and 8 has seating means formed therein which can comprise a shallow socket 55. The shallow socket includes an upper arcuate wall 72 for engaging with the end 54 of the guide tube 48. The two corners 73 resulting in guide tube configuration due to the cutaway portion 52 fit into the corners 74 in the socket 55 produced by the arcuate portion 72 and the flat bridging portion 75. These corners 74 effectively inhibit rotational movement of the guide tube 48 that may be imparted to it. Two recesses 76 are provided radially from the socket 55 about 180° apart. These recesses 76 are designed to accept the bent portions 66 of the spring. As stated the cap 56 is secured to the housing by means of machine screws which are threaded into female threaded bores in the housing as seen most clearly from FIG. 8.

In assembly, the spring 63 is positioned around the guide tube 48 and located with respect to the axis of the guide tube by the annular volume defined somewhat by the housing 60. As heretofore stated, the looped end 67 of the spring abuts the surface of the annular support wall 61. The turned in or bent ends 66 of the spring are received in holes 65 at the end portion 54 of the tube. In this position, the spring is compressed when the end cap 56 is secured in position by the screws 57 and thereby the spring 63 exerts a force that urges the end of the tube into the socket 55. The turned in or bent ends 66 of the spring 63 are accommodated in the recesses 76 which are so shaped that the ends 66 cannot disengage from the holes 65 while the spring is under compression. The cap 56 closes the open end 69.

The guide tube 48 by the mechanism and structure just discussed is thus resiliently supported in position. Even though the guide tube 48 is not positively secured by screws or the like it is nevertheless firmly held in place. It has been found that vibration experienced by the guide tube 48 will not affect its position and therefore the utilization afforded. Yet, the guide tube 48 may easily be removed when necessary by simply removing the cap 56 and then withdrawing the guide tube from the housing 60.

It will be appreciated that the construction herein described does not rely upon the manufacture to close tolerances of the surrounding housing, the guide tube or the annular support wall. Additionally, the resiliency of the spring accommodates differential thermal expansion that may occur between certain components of the tool, for example between the guide tube and the housing.

The rotary hammer of the present invention is operated in a conventional manner. The operator holds the tool by means of the handle, which in the form illustrated is likened to a pistol grip and a forward handle (not shown) and is able to control the energization of the electric motor by means of a control switch which is trigger operated.

Although the invention has been described in its application to rotary percussive drills, it will be appreciated that it has other applications and may be embodied in power tools of other forms for example, hedge trimmers and impact wrenches.

I claim:

1. In a combination rotary and percussive portable tool driven by prime motive means wherein the percussive means includes a reciprocating cylinder in a housing having embodied therein a reciprocatable piston striker which imparts percussive shocks, the cylinder being adapted and constructed to be reciprocated in a guide tube by crank means operatively positioned alongside the cylinder, the guide tube being mounted in the housing and having a cutaway section from one end portion for a distance to thereby avoid the eccentric crank means when said cylinder is operated, the housing being in surrounding spaced relationship to the guide tube, the improvement comprising:

an annular wall secured internally of said housing and concentrically around said guide tube at a point beyond said cutaway section; a spring positioned between said annular wall and affixed to one end portion of said guide tube, said housing having an end opening whereby the guide tube and spring may be removably inserted therein; and a removable cap mountable over said opening, the inwardly facing portion of said cap being adapted to be an abutment for said end portion of said guide tube.

2. The combination of claim 1 wherein the inwardly facing portion of the cap has a recess adapted and constructed to accept a portion of the end portion of said guide tube.

3. The combination of claim 2 wherein the recess in said cap has a contour to be complementary with the outer circumference of the portion of the end portion of the guide tube.

4. The combination of claim 1 wherein the spring has a loop portion in abutment with said annular wall and two extending arcuate limb portions, said guide tube has at the said end portion two radially disposed holes, the limb portions of the spring terminating with turned in portions positioned into said holes.

5. The combination of claim 4 wherein the arcuate limb portions of the spring each define two arcs which subtend approximately 270°.

6. The combination of claim 4 wherein the cap has two secondary recesses extending from the recess in the cap adapted and constructed to receive the turned in portions of the spring.

7. The combination of claim 3 wherein the contour of the recess has a flat bridging portion where the guide tube has been cut away whereby the guide tube is prevented from rotating.

8. The combination of claim 7 wherein that the spring has a loop portion in abutment with said annular wall and two extending arcuate limb portions, said guide tube has at the said end portion two radially disposed holes, the limb portions of the spring terminating with turned in portions positioned into said holes.

9. The combination of claim 8 wherein the cap has two secondary recesses extending from the recess in the cap adapted and constructed to receive the turned in portions of the spring.

10. A rotary hammer, comprising:

a housing;

a guide tube mounted in said housing and extending axially therein;

a reciprocating member received in said guide tube and adapted to be reciprocated axially therein for transmitting impact energy to a drill bit when removably received in the rotary hammer;

first mounting means, arranged in said housing, for laterally supporting said guide tube at a first axial location thereon;

second mounting means, arranged with respect to said housing, for laterally supporting said guide tube at a second axial location thereon;

seating means, receiving said guide tube in abutment axially thereagainst, for preventing movement of said guide tube in one axial direction; and resilient means, arranged in said housing, for resiliently urging said guide tube in said one axial direction against said seating means, whereby said guide tube is firmly located in axial position with respect to said first and second mounting means.

11. A portable power tool, comprising:

a housing of the power tool;

an electric motor mounted in said power tool housing;

a guide tube housing in said power tool housing;

a guide tube mounted in said guide tube housing and extending axially therein;

a reciprocating member received in said guide tube and adapted to be reciprocated axially therein relative to said guide tube for transmitting energy to tool means for acting upon a workpiece;

crank means, adapted to be driven by said motor, for reciprocating said reciprocating member;

seating means, closing one end of said guide tube housing, for laterally supporting said guide tube at one end thereof and also preventing movement of said guide tube in one axial direction;

a support wall surrounding said guide tube and laterally supporting said guide tube in said guide tube housing at a location spaced axially from said seating means; and a spring mounted in said guide tube housing and resiliently urging said guide tube in said one axial direction into abutment with said seating means, whereby said guide tube is firmly positioned axially with respect to said guide tube housing.

12. A rotary and percussive portable power tool, comprising:

a housing;

a guide tube mounted in said housing and extending axially therein;

a reciprocating member received in said guide tube and adapted to be reciprocated axially therein relative to said guide tube for transmitting energy to tool means for acting upon a workpiece;

seating means, closing one end of said housing, for laterally supporting said guide tube at one end thereof and also preventing movement of said guide tube in one axial direction;

said seating means and said guide tube having cooperating abutting portions which prevent said guide tube from rotating;

a support wall surrounding said guide tube and laterally supporting said guide tube in said housing at a location spaced axially from said seating means; and a spring mounted in said housing and resiliently urging said guide tube in said one axial direction into abutment with said seating means, whereby said guide tube is firmly positioned axially with respect to said housing.

13. A portable power tool, comprising:

a housing;

a guide tube mounted in said housing and extending axially therein;

a reciprocating member received in said guide tube and adapted to be reciprocated axially therein relative to said guide tube for transmitting energy to tool means for acting upon a workpiece;

seating means, closing one end of said housing, for laterally supporting said guide tube at one end thereof and also preventing movement of said guide tube in one axial direction;

a support wall surrounding said guide tube and laterally supporting said guide tube in said housing at a location spaced axially from said seating means;

a spring mounted in said housing and resiliently urging said guide tube in said one axial direction into abutment with said seating means, whereby said guide tube is firmly positioned axially with respect to said housing;

said housing having an end opening whereby said guide tube and said spring can be removably inserted therein; and said seating means comprises a removable cap mountable over said opening, the inwardly facing portion of said cap being adapted to be an abutment for said one end of said guide tube.

14. A portable power tool, comprising:

a housing;

a guide tube mounted in said housing, said housing being in surrounding spaced relationship to said guide tube;

a reciprocating member received in said guide tube and adapted to be reciprocated axially therein relative to said guide tube for transmitting energy to a tool member;

a cap removably attached to said housing and having a socket formed therein, one end of said guide tube being positioned in said socket;

a support plate in said housing and through which said guide tube is mounted; and a spring partially encircling said guide tube and having an end that reacts against said support plate, the other end thereof reacting with said guide tube thereby resiliently urging said guide tube against said cap and into said socket.

* * * * *